US009510084B2

(12) United States Patent
Lott

(10) Patent No.: US 9,510,084 B2
(45) Date of Patent: Nov. 29, 2016

(54) CUSTOM IN-EAR MONITOR

(71) Applicant: Aurisonics, Inc., Nashville, TN (US)

(72) Inventor: Phillip Dale Lott, Nashville, TN (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 0 days.

(21) Appl. No.: 14/718,163

(22) Filed: May 21, 2015

(65) Prior Publication Data

US 2015/0264471 A1 Sep. 17, 2015

Related U.S. Application Data

(63) Continuation of application No. 13/619,744, filed on Sep. 14, 2012, now Pat. No. 9,113,266.

(60) Provisional application No. 61/534,404, filed on Sep. 14, 2011.

(51) Int. Cl.

| | |
|---|---|
| ***H04R 29/00*** | (2006.01) |
| ***H04R 31/00*** | (2006.01) |
| ***H04R 1/10*** | (2006.01) |
| ***H04R 1/28*** | (2006.01) |

(52) U.S. Cl.

CPC ..... *H04R 1/1091* (2013.01); *H04R 1/1016* (2013.01); *H04R 1/1058* (2013.01); *H04R 1/2811* (2013.01); *H04R 29/00* (2013.01); *H04R 31/00* (2013.01); *Y10T 29/49005* (2015.01)

(58) Field of Classification Search

USPC ..... 381/23.1, 74, 312, 320–322, 324, 325, 381/328, 372, 380; 181/129, 130, 135

See application file for complete search history.

(56) References Cited

U.S. PATENT DOCUMENTS

| | | | |
|---|---|---|---|
| 7,194,102 | B2 | 3/2007 | Harvey |
| 7,194,103 | B2 | 3/2007 | Harvey |
| 7,263,195 | B2 | 8/2007 | Harvey et al. |
| 7,634,099 | B2 | 12/2009 | Harvey et al. |
| 7,986,803 | B1 | 7/2011 | DeKalb |
| RE42,602 | E | 8/2011 | Krywko |
| 8,061,473 | B1 | 11/2011 | Kerr |
| 2008/0247561 | A1 | 10/2008 | Smith |
| 2011/0058702 | A1 | 3/2011 | Saggio, Jr. |
| 2012/0087511 | A1 | 4/2012 | Lumsden et al. |

FOREIGN PATENT DOCUMENTS

| | | | |
|---|---|---|---|
| JP | 2000078689 | A | 3/2000 |

*Primary Examiner* — Brenda Bernardi

(74) *Attorney, Agent, or Firm* — Hall Estill Attorneys at Law; Tyler J. Mantooth

(57) ABSTRACT

An in-ear monitor that can be customized for particular applications and individuals includes a housing formed from a body and a cover. A dynamic driver is mounted in a cavity in the housing on an angled mounting flange. The dynamic driver is acoustically coupled to a trumpet-shaped sound collector. The trumpet-shaped sound collector is coupled to a main sound bore that exits an opening in a nozzle portion of the body that is inserted into the ear canal of a user. An ambient sound port collects ambient sound and couples it to the sound bore. An additional bass port increases the bass response of the monitor. Ear impressions are used to customize the body of the monitor to the ear of a user and the location of the bass and ambient sound ports can be altered for different applications.

19 Claims, 17 Drawing Sheets

CUSTOM IN-EAR MONITOR

RELATED APPLICATIONS

The present application is a continuation of U.S. patent application Ser. No. 13/619,744 filed Sep. 14, 2012, which claims priority to U.S. Provisional Patent Application No. 61/534,404 filed Sep. 9, 2011, the contents of which are hereby incorporated by reference.

BACKGROUND OF THE INVENTION

Musicians, performers and the like that need to hear themselves and other members of a band or performers in order to stay in-time and/or in-tune are required to utilize a methodology to hear one another called monitoring. Historically open speakers called floor wedges have been used to provide a combined mix of the performers voices, instruments and/or music tracks in order for the performers to hear other pertinent audio during the performance.

Some years ago legacy hearing aid in-ear custom molded monitors were introduced into the market. These custom in-ear monitors took the place of the floor \wedges. The custom in-ear monitors substantially reduced the amount of equipment needed for the performers, lowered overall stage volume and reduced risk of hearing damage from performers by allowing the overall monitoring level to be lower.

Since the advent of custom in-ear monitors the process for manufacturing them and the resulting product has not changed very much. This can be attributed to limited types of speaker technologies, legacy manufacturing methods utilized and materials and parts available for assembly. Although these methods and materials work, they fall short in many areas. These areas include: low frequency performance, sweat abatement into the inside, cerumen vapor intrusion, comfortable yet sealed canal lengths, ruggedization, reparability, digital manufacturing methodologies, precision internal parts, use of hybrid driver configurations, tenability, placement and sound bore diameter and length calculation for optimal performance.

With this the need exists for a better design which answers all of these shortcomings. A better custom in-ear monitor needed to be designed to better serve those who utilize them for their very livelihood.

BRIEF SUMMARY OF THE INVENTION

An embodiment of the present invention is directed toward an in-ear monitor that is contained within a housing having a cover and a body. A trumpet-shaped sound collector is positioned in the housing. A main sound bore is acoustically coupled to the trumpet-shaped sound collector. A nozzle having a nozzle opening in the body is acoustically coupled to the sound bore. The nozzle includes a recessed channel and a sealing o-ring positioned on a tip of the nozzle that function as an ear canal seal. A bass port is acoustically coupled to the nozzle opening. An ambient port is also preferably acoustically coupled to the nozzle opening. A dynamic driver, such as a coaxial speaker or balanced armature receiver, is coupled to the trumpet shaped sound collector. The bass port preferably has a bass port valve that selectively restricts a sound flow through the bass port. The ambient port preferably includes an ambient port valve that selectively restricts a sound flow through the ambient port. A balanced armature receiver is acoustically coupled to the main sound bore. The balanced armature receiver is most preferably positioned directly inside the main sound bore.

Another embodiment of the present invention is directed toward a method of constructing a custom in-ear monitor. The method begins with the obtaining of an ear impression from a customer. A digital body model of a monitor body is created based on the ear impression. The digital model is then manipulated to remove surface abnormalities. Component templates are positioned in the digital body model. A driver is preferably mounted in the body and a balanced armature receiver is preferably positioned in a main sound bore of the in-ear monitor. The loft of a speaker mount in the in-ear monitor is adjusted to accommodate the selected driver. Valve adjustments are provided for a bass sound port and an ambient sound port of the in-ear monitor. The component templates are extracted from the digital body model. A cover template is fitted onto an upper surface of the digital body model. The in-ear monitor is then manufactured based upon the modified digital body model.

DETAILED DESCRIPTION OF THE INVENTION

The present invention is directed toward an in-ear monitor that can be customized for particular applications and individuals. The monitor includes a housing formed from a body and a cover. A dynamic driver is mounted in a cavity in the housing on an angled mounting flange. The dynamic driver is acoustically coupled to a trumpet-shaped sound collector. The trumpet-shaped sound collector is coupled to a main sound bore that exits an opening in a nozzle portion of the body that is inserted into the ear canal of a user. An ambient sound port collects ambient sound and couples it to the sound bore. An additional bass port increases the bass response of the monitor. Ear impressions are used to customize the body of the monitor to the ear of a user and the location of the bass and ambient sound ports can be altered for different applications.

Figure 1:
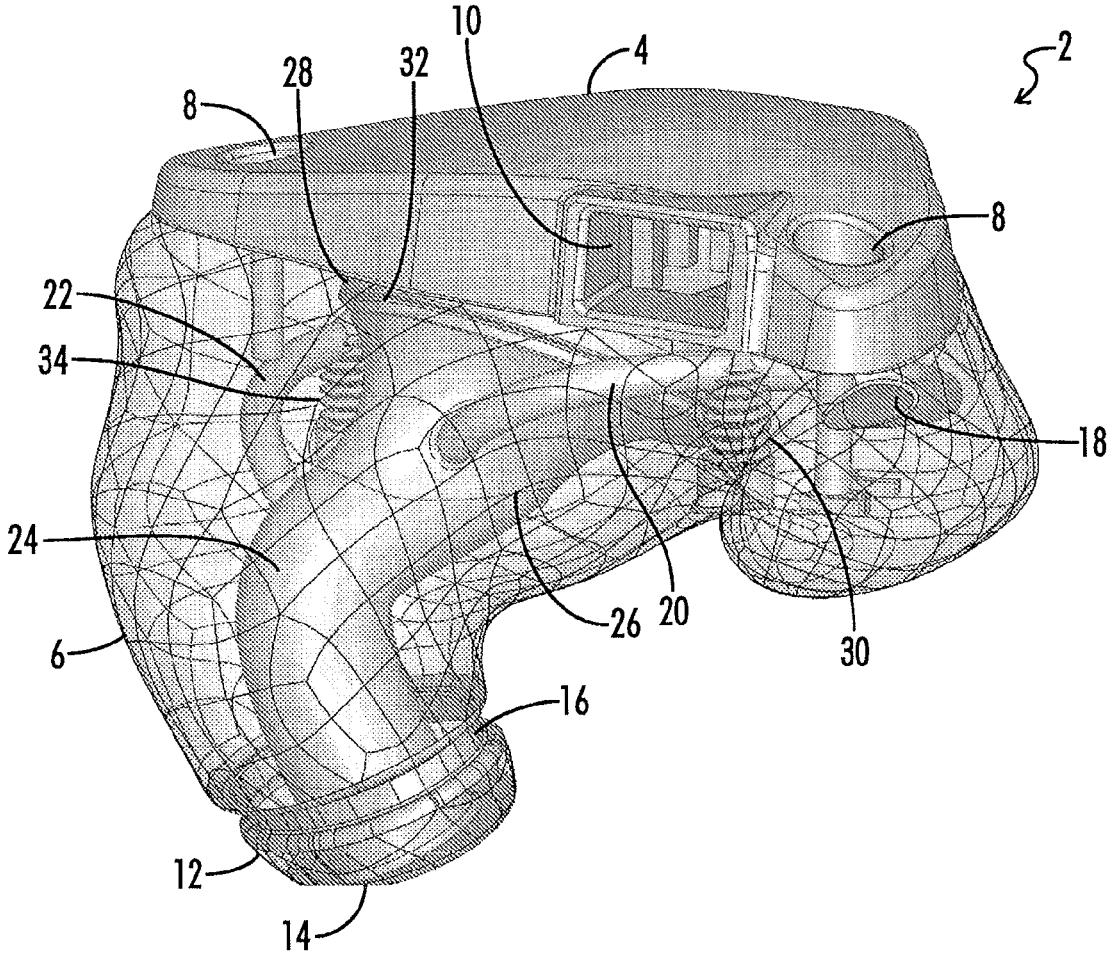
FIG. 1 is a three-dimensional drawing of an in-ear monitor constructed in accordance with an embodiment of the present invention.

Referring now to FIG. 1, a three-dimensional drawing of an in-ear monitor constructed in accordance with an embodiment of the present invention is shown. The monitor 2 includes a cover 4 that mates with a body 6 to form an outer shell for the monitor. The cover 4 has openings 8 for attachment screws and a recessed connector 10 that receives a cable connector. The body 6 includes a nozzle 12 with a nozzle opening 14 that is inserted into the ear of a user. An ear canal seal or o-ring groove 16 that receives an o-ring, as discussed in more detail below, is provided around the nozzle opening 14 help seal the nozzle 12 in the ear of the user. The body 6 also includes an external opening 18 for the ambient sound port 20 and an external opening for the bass sound port 22.

The in-ear monitor 2 preferably has a main smooth-flowing sound bore 24 acoustically coupled to a trumpet-shaped sound collector 26 that smoothly channels sound down the main sound bore 24 into the ear of the user. This configuration does not disturb the natural flow of sound from a dynamic driver 28 down the main sound bore 24 and creates a smooth path to the ear through the nozzle 12. An angled driver flange 32 is used to mate the sound collector 26 with the dynamic driver or speaker 28. As discussed in more detail herein, an ambient port valve 30 is used to selectively restrict the ambient sound port 20 and a bass port valve 34 is used to selectively restrict the bass sound port 22. Needle valves are preferably used to adjust the porting of the bass and ambient sound channels. However, any small valve design such as a slide valve, ball valve or butterfly valve can be utilized to adjust the porting.

The in-ear monitor 2 has an enlarged main sound bore 24 that is preferably 3-6 mm in diameter. The large size of the sound bore 24 reduces any effects of sweat which can clog standard sound bore tubes. It also allows for easy cleaning with a Q-tip to remove ear wax buildup.

Figure 2:
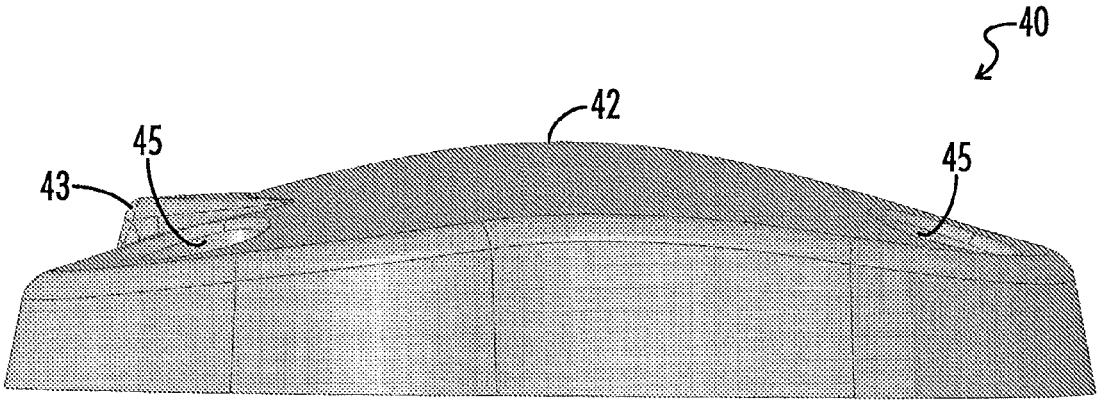
FIG. 2 is an illustration of a preferred cover for an in-ear monitor constructed in accordance with an embodiment of the present invention.

Referring now to FIG. 2, an illustration of a preferred cover 40 design for an in-ear monitor constructed in accordance with an embodiment of the present invention is shown. The preferred cover 40 has an 11 degree draft, + or −5 degrees, to allow the speaker to fit within the concha bowl of the ear. This also allows the cover 40 to follow basic contour of the perimeter of the ear without causing excessive pressure on the edge of the helix and concha. The contoured shaped cover 40 has a bulge 42 that allows the speaker magnet to clear the cover surface and increases the air volume on the back side of speaker.

The connector 43 for the in-ear monitor cable is recessed into the cover 40 for added comfort and strength. The recessed connector 43 is used to connect the ear monitor to a wired or wireless belt pack receiver, or other amplified audio source. Recessing the connector 43 reduces strains placed on the connector that result from pulling on the cable attached to the connector.

The cover 40 is preferably constructed so that a recessed logo can be engraved in the outer surface of the cover. This gives a dimensional look to any text or logo added to the cover and can be easily painted to enhance the visual appearance of the cover. The cover 40 can be made of almost any material such as carbon fiber, wood, ivory, mother of pearl, etc. The cover 40 can also be plated with metals such as chrome, gold, black rhodium, etc.

The cover 40 is preferably attached with recessed, stainless, self-tapping T-3 torx bit screws. These screws thread themselves into the 1.1 mm×6 mm holes 45 on the body to attach the cover 40 and allow its removal when needed for repair or cleaning. While torx bit screws are preferred, any type of suitable of screw can be used.

Figure 3:
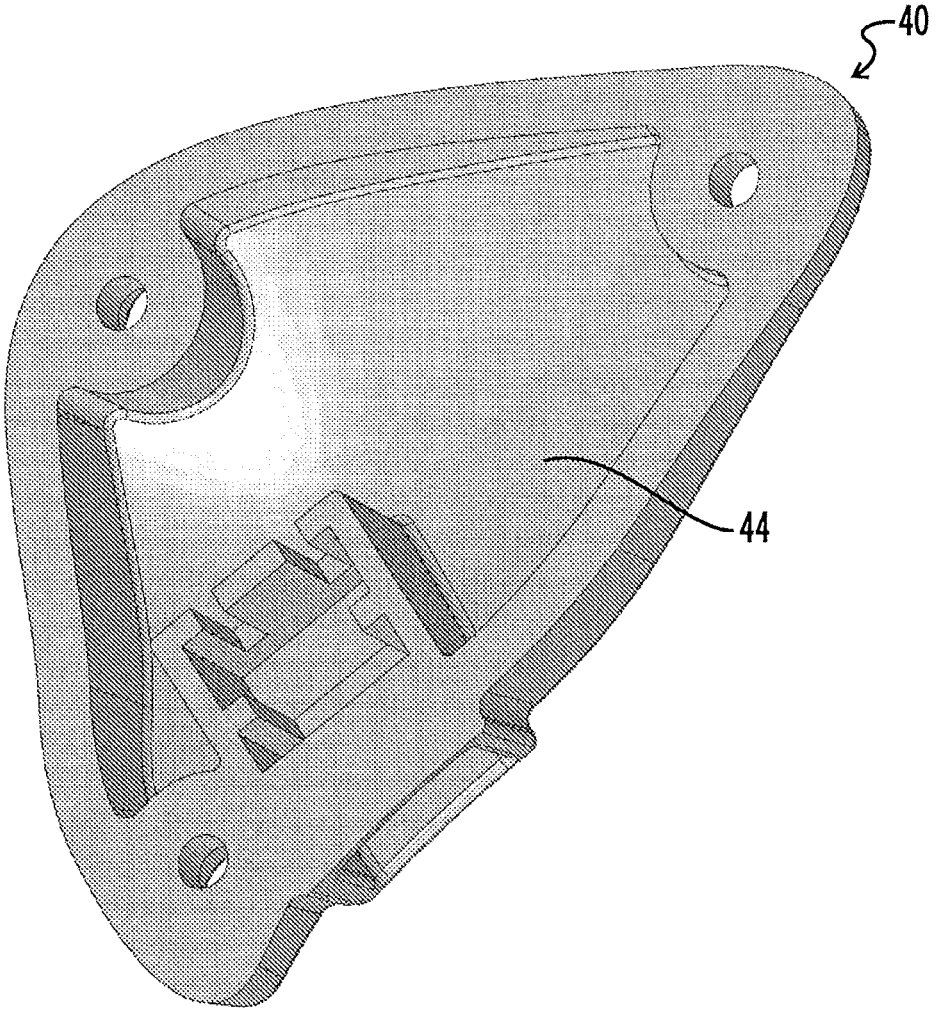
FIG. 3 is an illustration of a shaped cavity constructed in a cover for an in-ear monitor in accordance with an embodiment of the present invention.

As shown in FIG. 3, the inside surface of the cover 40 of the in-ear monitor preferably includes a shaped cavity 44. The shaped cavity 44 adds significant air volume to the back side of speaker which increases the low frequency response of the in-ear monitor speaker.

Figure 4:
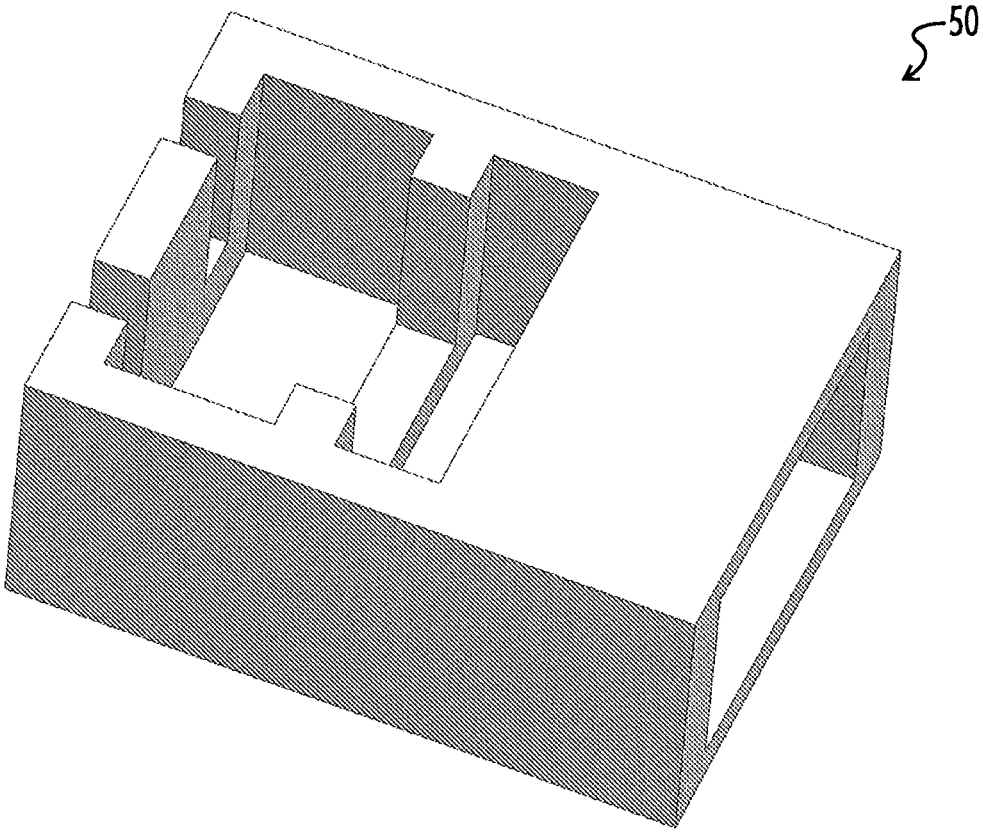
FIG. 4 is an illustration of a solid model insert used to expedite custom in-ear monitor cover designs in accordance with an embodiment of the present invention.

As shown in FIG. 4, a solid model insert 50 may be used to expedite custom monitor designs. Utilizing digital models 50 of the parts that will fit into the shell allows you to both precisely fit them into the model of each person's car with high accuracy, which cannot be achieved any other way, and use them to form cavities corresponding to the dimensions of the inserted parts models. Once the solid model parts 50 are placed in the solid model of the ear they can then be extracted. This extracting causes a negative cavity of each part to be formed. These resulting areas can then be further worked utilizing CAD software to ensure everything fits together, the speakers can be inserted in the 3D printed version, perfect fit into the ear, threads formed for valves, and accurate porting achieved. Additionally utilizing this method allows for precise air volume calculation and modeling as well as sound bore placement and size for each individuals ear. Thus, using an add-in cad template for non-custom mechanical parts enables faster design of the monitor in the 3D cad environment.

Figure 5A:
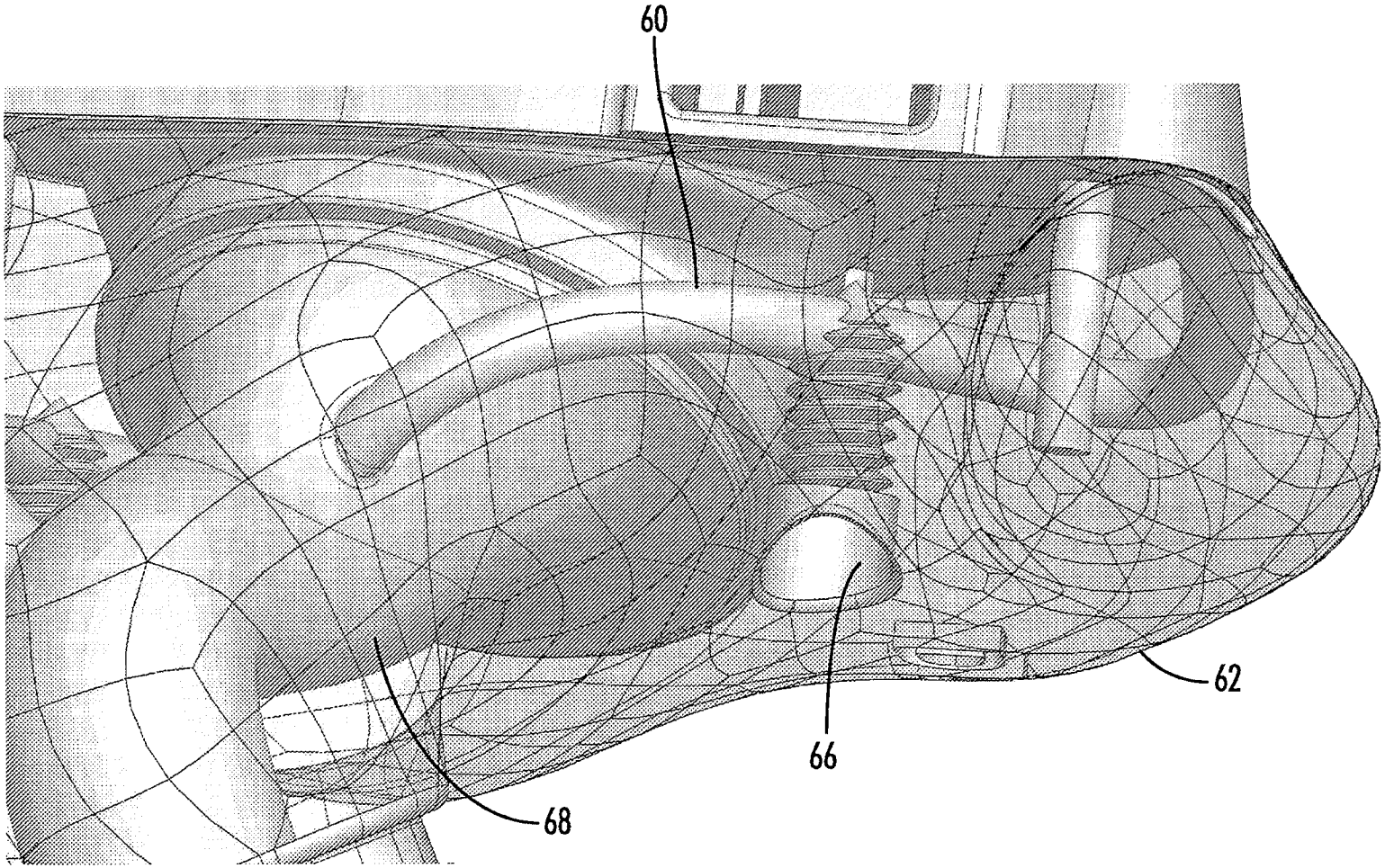
FIGS. 5(A-D) are illustrations of alternative ambient port configurations in accordance with the present invention.
Figure 5B:
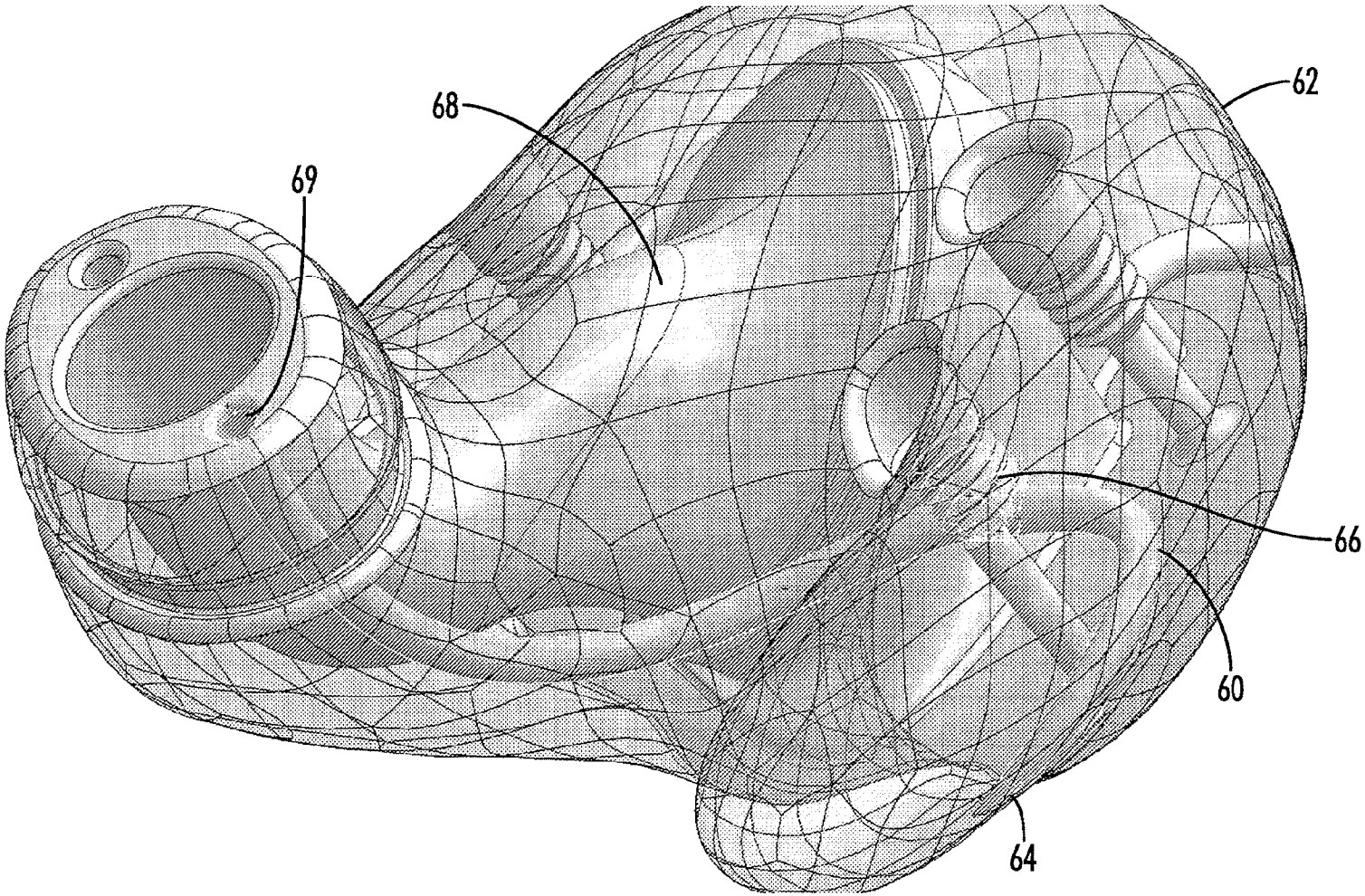

As discussed above an ambient sound port is positioned in the body. The ambient sound port 60 can be positioned in the body 62 in one of two different manners. As shown in FIG. 5(A), the ambient port 60 can be routed from the ambient port opening through an ambient valve 66 to an opening in the main sound bore 68. Alternatively, as shown in FIG. 5(B), the ambient port 60 can be routed from the ambient port opening 64 through the ambient valve 66 to an opening 69 near the tip of the canal opening. This arrangement provides for increased bass response.

Figure 5C:
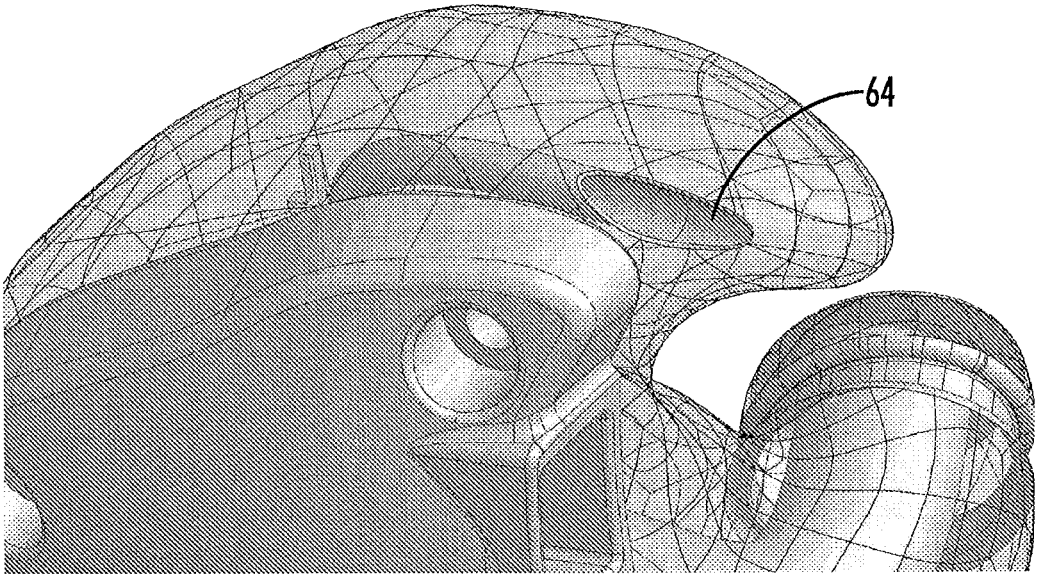
Figure 5D:
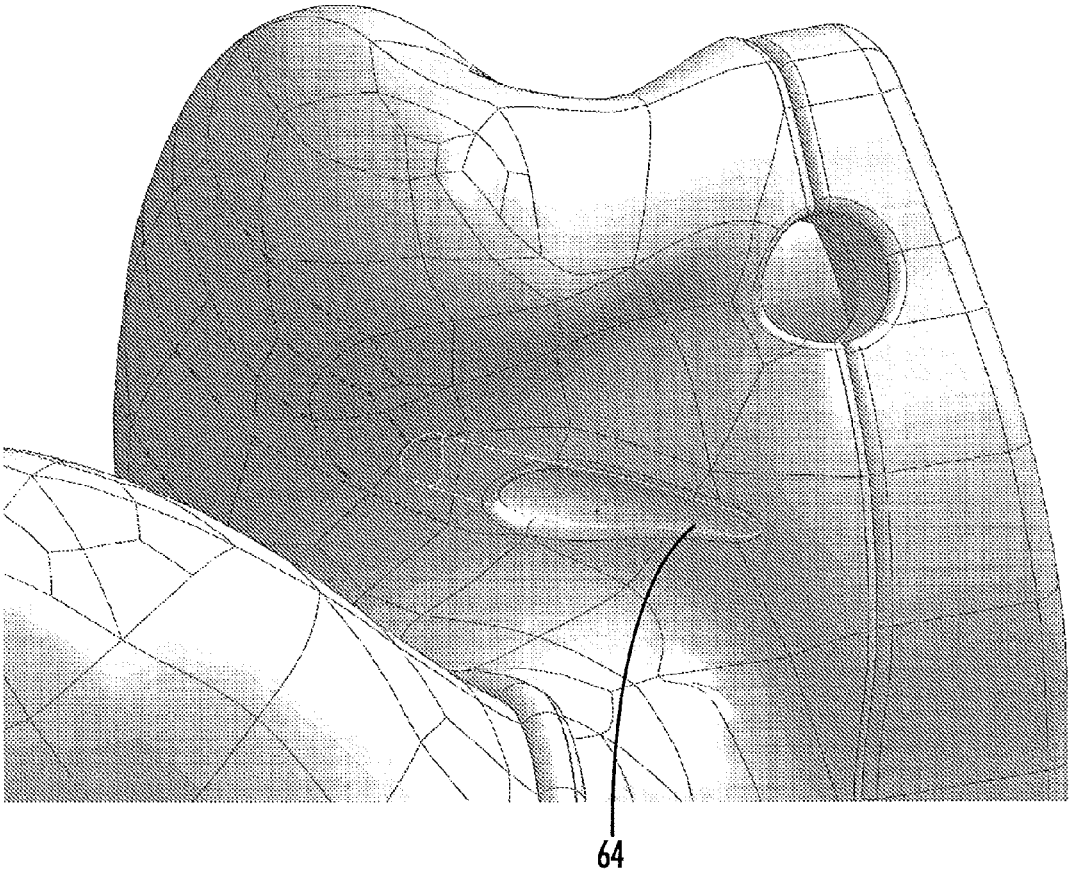

The ambient port opening 64 can also be positioned in two different locations. As shown in FIG. 5(C), positioning the ambient port opening 64 at the helix of the ear accommodates different ear shapes and allows for directional hearing or hearing localization such that the user can hear in a more normal manner. Alternatively, as shown in FIG. 5(D), the ambient port opening 64 may be placed between the tragus and helix behind the connector or wire for the in-ear monitor.

Figure 6A:
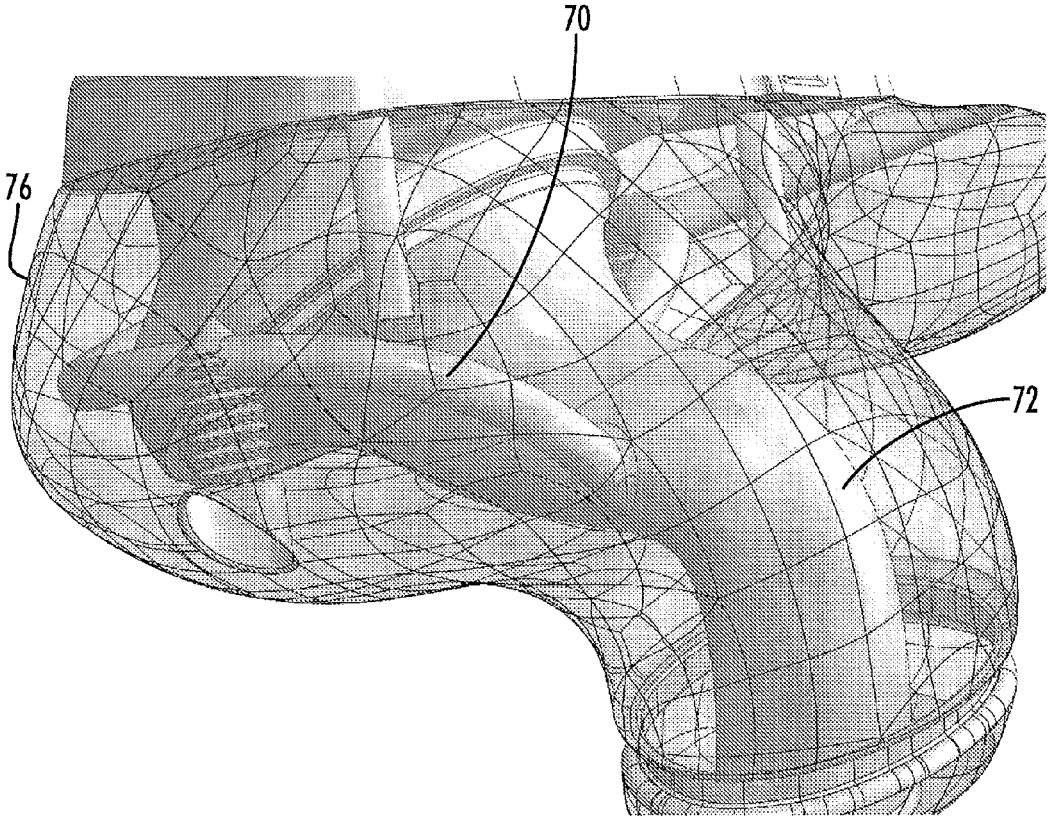
FIGS. 6(A-C) are illustrations of alternative bass port placements in accordance with the present invention.
Figure 6B:
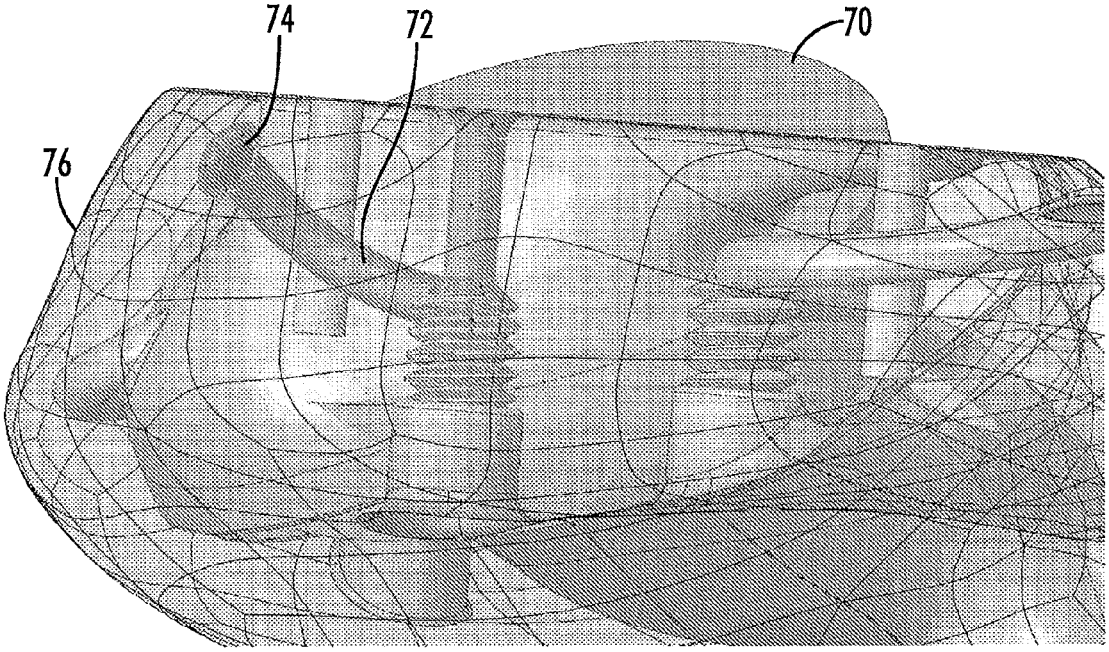
Figure 6C:
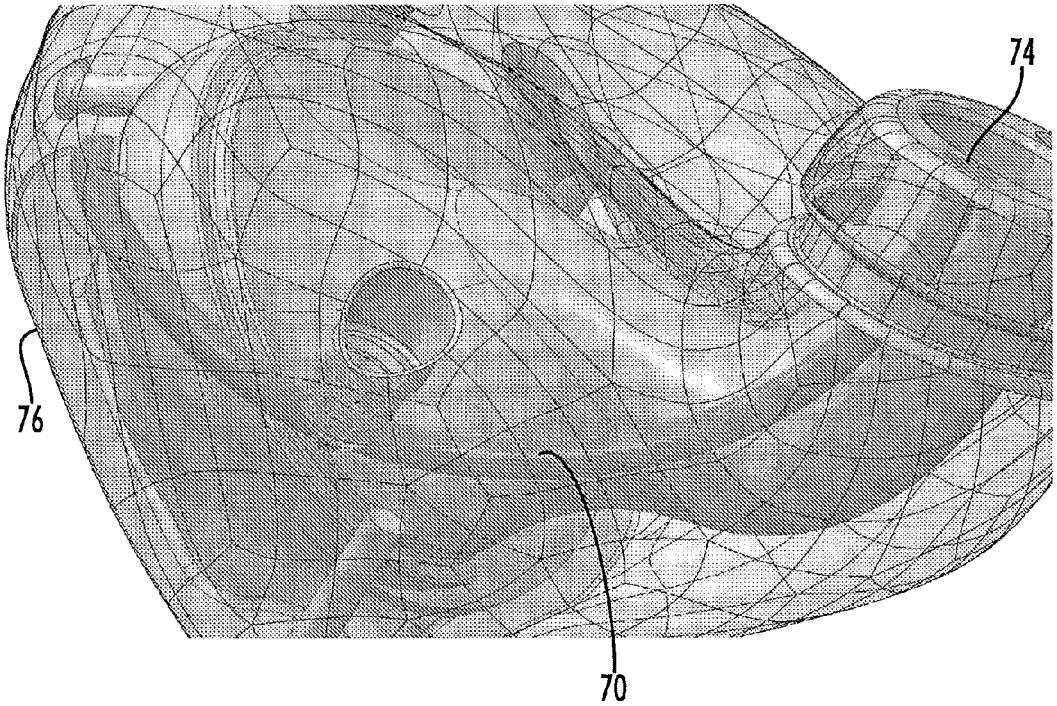

As shown in FIGS. 6(A-C), the exit for the bass port 70 in the in-ear monitor can be positioned in one of three different preferred locations. In the first position, FIG. 6(A), the bass port 70 is routed from inside the rear speaker air volume through the valve area into the main sound bore 72. In the second position, the bass port 70 is routed from inside the rear speaker air volume through the valve area to an external vent 74 located on the outside of the shell 76. The external vent 74 can be placed anywhere that allows it to be open and not closed off by the ear. In the third position, the bass port 70 is vented from the backside of speaker air volume through the valve area to an external vent opening 74 positioned at tip of the canal opening.

Figure 7:
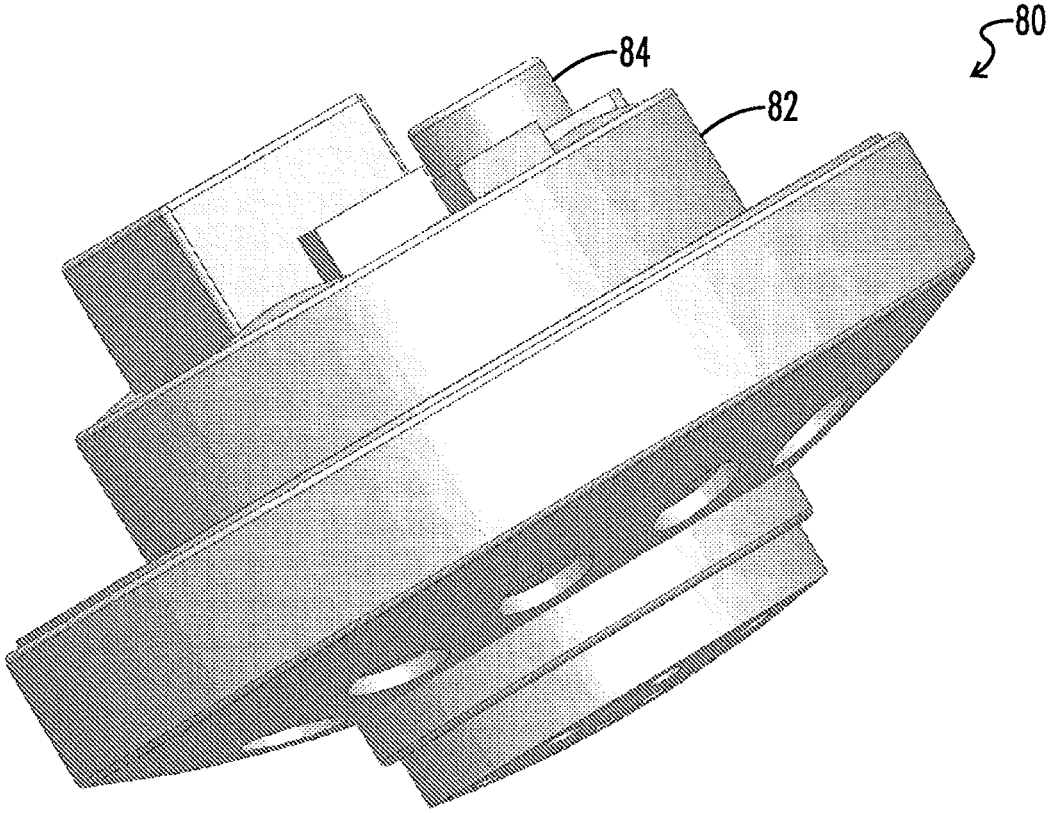
FIG. 7 is an illustration of a coaxial speaker for use in an embodiment of the present invention.

As shown in FIG. 7, the in-ear monitor if the present invention preferably utilizes a coaxial, adjustable speaker 80 for a flatter frequency response. The speaker has dual dynamic drivers 82 and 84 that are driven by an amplified sound source. The larger driver 82 is for bass response while the smaller 84 is for mid and high range frequencies. Multiple smaller drivers can be utilized in connection with the coaxial speaker for enhanced response. An IPEX connector or solder pads can be used for wiring to the external connector. Crossovers or filters are used to reduce undesirable low and/or high frequencies in the inputs to the drivers. A potentiometer is preferably used to tune in the amount of speaker output.

Figure 8:
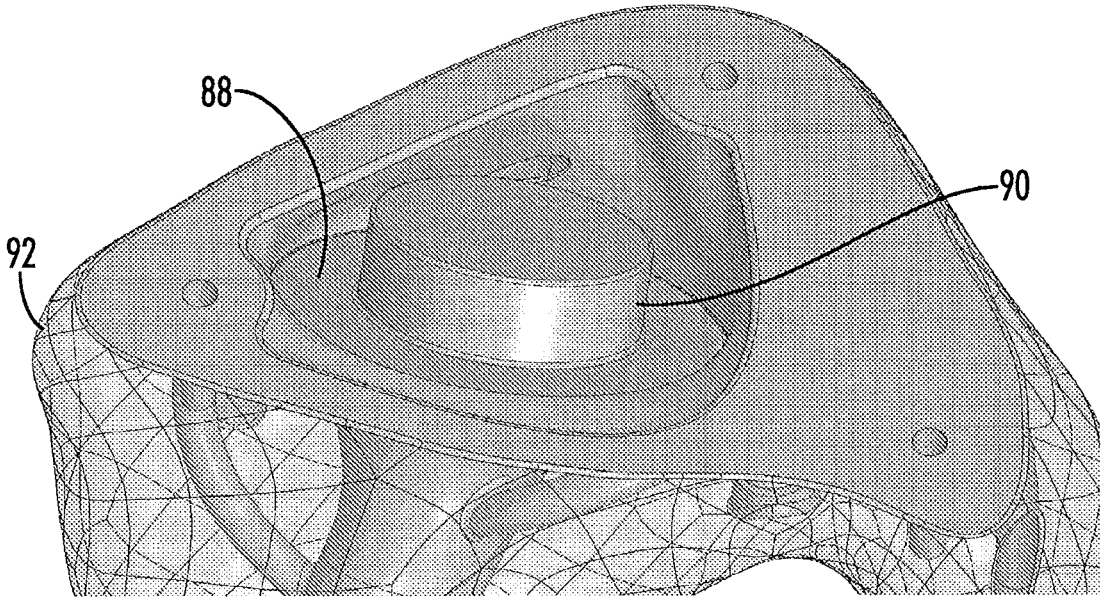
FIG. 8 is an illustration of a lofted cut out area or angled mounting flange in the in-ear monitor into which a driver is inserted in accordance with an embodiment of the invention.

As shown in FIG. 8, a lofted cut out area or angled mounting flange 88 is provided in the shell into which the speaker 90 is inserted. The lofted cut out area 88 allows for the speaker 90 to be inserted into the mounting area at an acute angle. The amount of loft is selected such that the custom position of the speaker 90 can be mated with the flat plane of the top of the body 92.

Figure 9A:
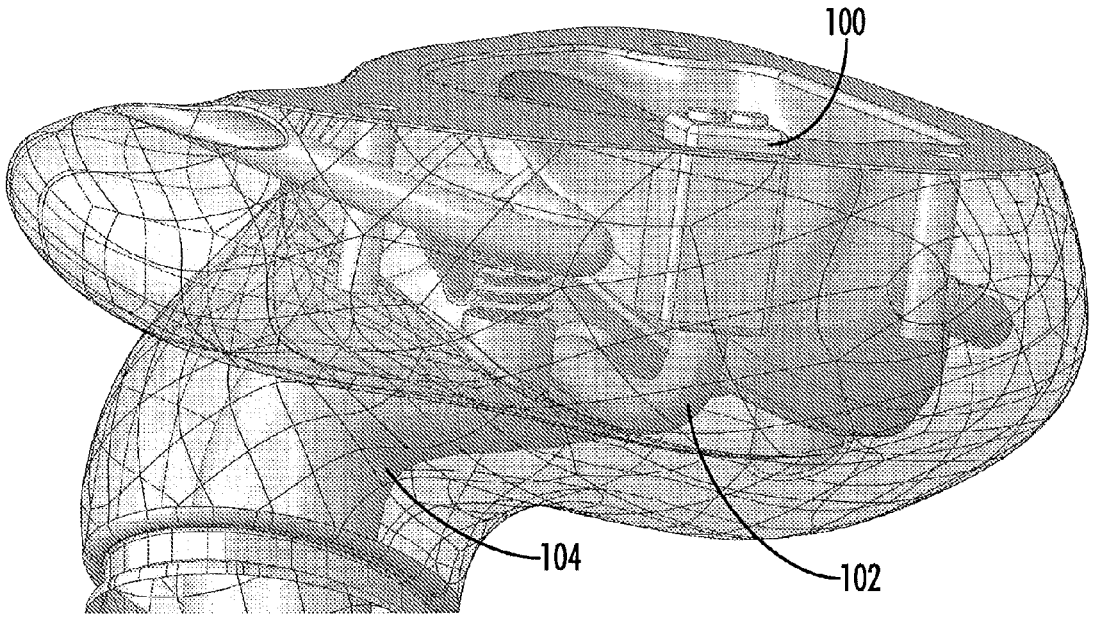
FIGS. 9(A) and 9(B) are illustrations of balanced armature receiver placements in accordance with embodiments of the present invention.
Figure 9B:
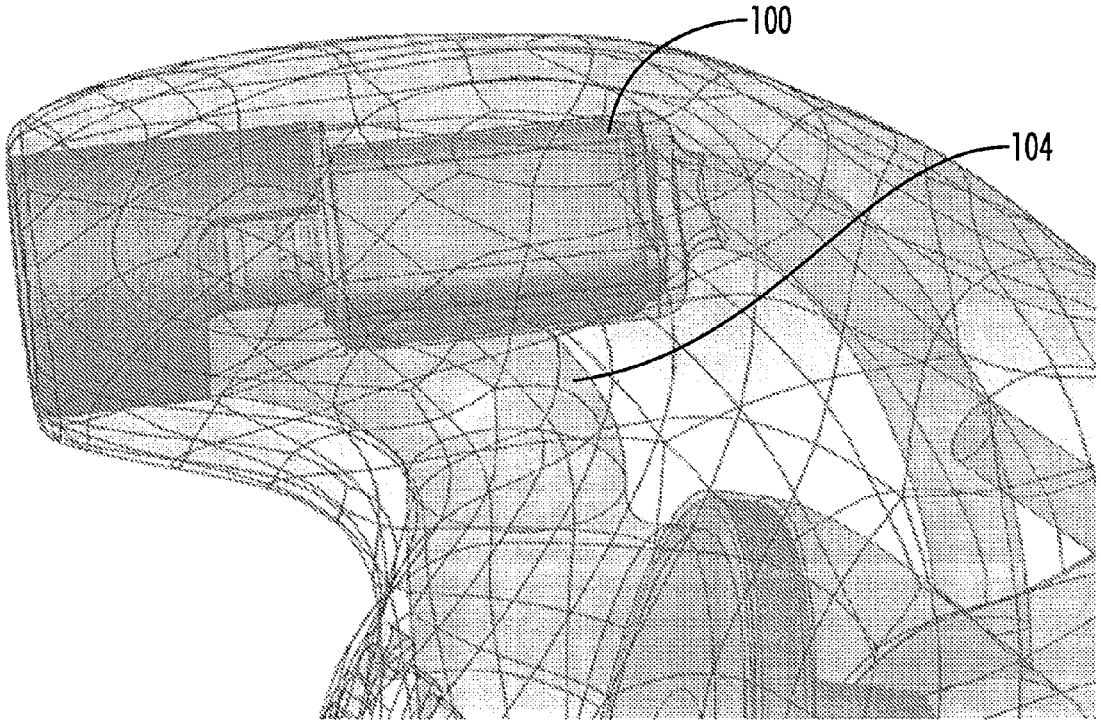

The in-ear monitor preferably makes hybrid use of both dynamic drivers and balanced armature receivers for added high frequency response. As shown in FIG. 9(A), the balanced armature receiver 100 can be connected with sound tubes 102 to the main sound bore 104. Placement of the balanced armature receiver 100 can be made anywhere it will fit inside the outer shell and then ported into the main audio bore at any point that works for a particular application. In addition, as shown in FIG. 9(B), a balanced armature receiver 100 can be positioned in the center of the main audio bore 104. Positioning the balanced armature receiver 100 directly in the main sound bore 104 can greatly enhance the directed performance of the balanced armature speaker. Any number of balanced armature receivers can be added to the in-ear monitor to augment the frequency response.

Figure 10:
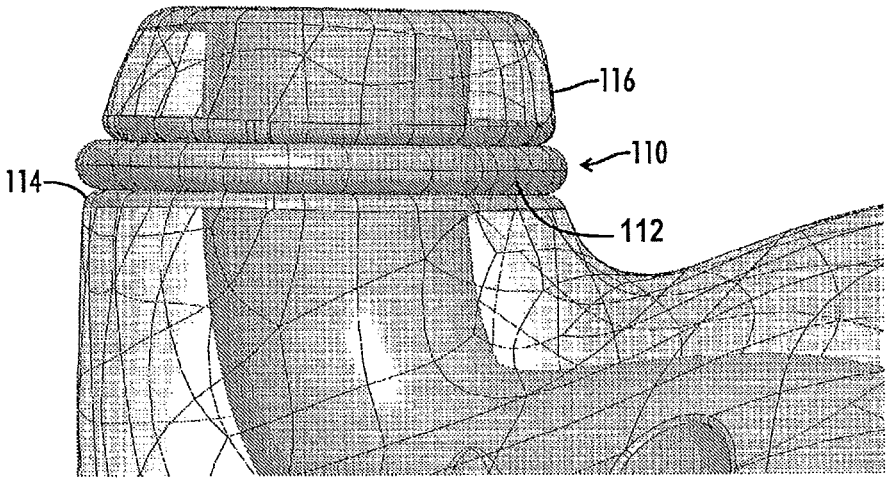
FIG. 10 is an illustration of an enhanced ear canal seal in accordance with an embodiment of the invention.

As shown in FIG. 10, the in-ear monitor of the present invention utilizes an enhanced canal seal 110. The canal seal 110 is preferably 1 mm diameter an o-ring 112 that is inserted into a canal-shaped groove 114 that is 0.6 mm×1 mm on the tip of the nozzle 116 to provide an approximately 0.3-0.5 mm sealing surface in ear canal. These preferred dimensions can be changed to satisfy each individuals requirements for comfort and fit. This extra o-ring seal 110 on the nozzle 116 allows the portion of the monitor inserted into the canal to be shorter which makes the monitor more comfortable to wear.

Figure 11:
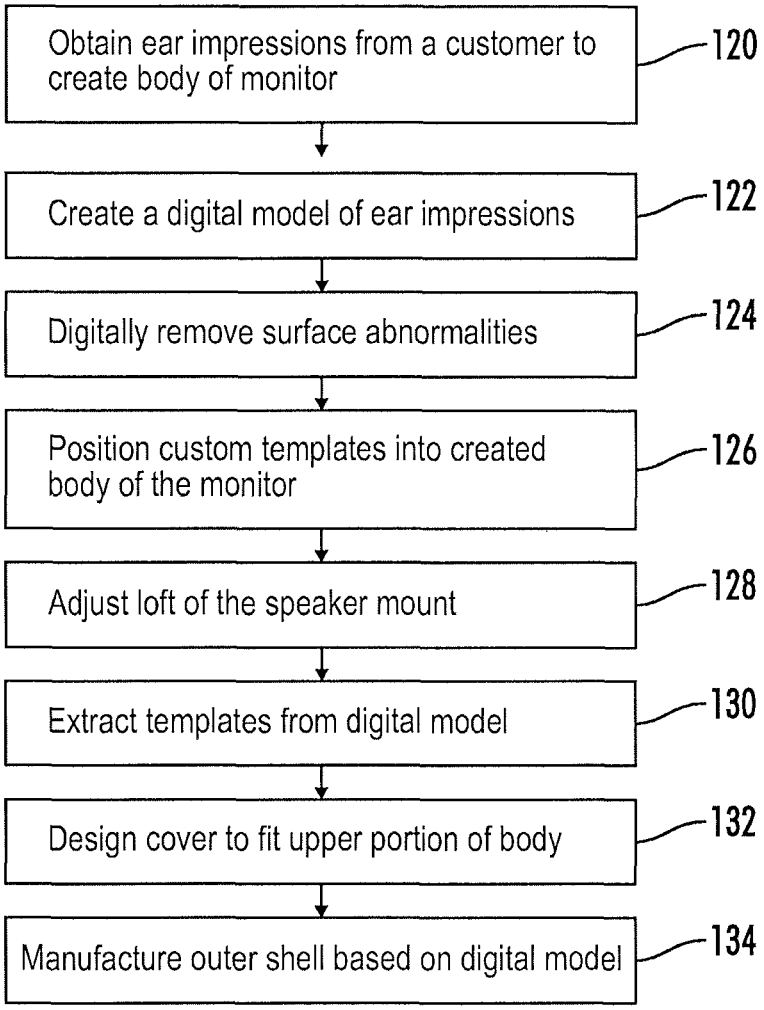
FIG. 11 is a flow chart of a preferred method of constructing a custom fitted in-ear monitor in accordance with the present invention.

As shown in FIG. 11, a preferred method of constructing a custom fitted in-ear monitor begins in step 120 with the taking of ear impressions from a customer. The ear impressions are then inserted into a three dimensional scanner to create a digital model of the ear impressions in step 122. In step 124, software is used to manipulate the digital model to remove surface abnormalities. Three dimensional cad design software is used in step 126 to position a custom templates into the body of the monitor. The loft of the speaker mount is adjusted in step 128 so that the speaker template can be fitted into the body. The templates are then extracted in step 130 from the body of the digital model. In step 132, a cover is then designed based on the outline of the flat plane at the top of the body. The digital model can then be modified and an outer shell created from the digitized model using three dimensional printing or other manufacturing techniques in step 134.

Although there have been described particular embodiments of the present invention of a new and useful IN-EAR MONITOR, it is not intended that such references be construed as limitations upon the scope of this invention except as set forth in the following claims.

What is claimed is:

1. An apparatus comprising:

a dynamic driver connected to a main sound bore inside a housing, the main sound bore having a first diameter; and a balanced armature receiver connected to the main sound bore with a sound tube positioned between a sound collector and an exit nozzle inside the housing, the sound tube having a second diameter, the second diameter being smaller than the first diameter.

2. The apparatus of claim 1, wherein the main sound bore has at least the first diameter from the exit nozzle to the dynamic driver.

3. The apparatus of claim 2, wherein the main sound bore has a varying diameter from the exit nozzle to the dynamic driver.

4. The apparatus of claim 1, wherein the dynamic driver comprises a large driver and a small driver.

5. The apparatus of claim 1, wherein the dynamic driver is physically larger than the balanced armature receiver.

6. The apparatus of claim 1, wherein the dynamic driver and balanced armature receiver are each electrically connected to an audio source via a cable connector recessed into the housing.

7. The apparatus of claim 1, wherein the housing is configured to fit in a user's ear.

8. An apparatus comprising a dynamic driver and a balanced armature receiver respectively connected to a main sound bore and a sound tube in a housing, the main sound bore having a larger diameter than the sound tube, the sound tube continuously extending from the main sound bore at a position between the dynamic driver and an exit nozzle portion of the main sound bore, an ambient port and bass port each continuously extend from different locations on the main sound bore to at least one exterior surface of the housing.

9. The apparatus of claim 8, wherein the ambient port is closed by a first valve and the bass port is closed by a second valve.

10. The apparatus of claim 9, wherein the first and second valves are each needle valves.

11. The apparatus of claim 9, wherein the first and second valves are different types of valves.

12. The apparatus of claim 9, wherein the first valve closes the ambient port at a location between the at least one exterior surface and the main sound bore.

13. The apparatus of claim 9, wherein the first and second valves are independent of each other.

14. The apparatus of claim 8, wherein the ambient and bass ports each continuously extend from an ear canal tip of the housing.

15. The apparatus of claim 8, wherein the bass port is positioned at a helix of a user's ear when the housing is inserted into the user's ear.

16. An apparatus comprising a dynamic driver and a balanced armature receiver respectively connected to a main sound bore and a sound tube in a housing, the main sound bore having a larger diameter than the sound tube, the main sound bore continuously extending from the dynamic driver to an exit nozzle, the sound tube continuously extending from the balanced armature receiver to the main sound bore.

17. The apparatus of claim 16, wherein the main sound bore and sound tube are each continuously smooth.

18. The apparatus of claim 16, wherein the first diameter is 3-6 mm.

19. The apparatus of claim 16, wherein the dynamic driver has a third diameter, the first diameter is smaller than the third diameter.

* * * * *